US006695063B2

(12) United States Patent
Lauritzen et al.

(10) Patent No.: US 6,695,063 B2
(45) **Date of Patent: *Feb. 24, 2004**

(54) EXPANSION ASSEMBLY FOR A TUBULAR EXPANDER TOOL, AND METHOD OF TUBULAR EXPANSION

(75) Inventors: J. Eric Lauritzen, Kingwood, TX (US); A. Craig Mackay, Aberdeen (GB); Neil A.A. Simpson, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 5 days.

This patent is subject to a terminal disclaimer.

(21) Appl. No.: 10/123,035

(22) Filed: Apr. 15, 2002

(65) Prior Publication Data

US 2002/0166664 A1 Nov. 14, 2002

Related U.S. Application Data

(63) Continuation-in-part of application No. 10/066,824, filed on Feb. 4, 2002, which is a continuation-in-part of application No. 09/469,690, filed on Dec. 22, 1999, now Pat. No. 6,457,532.

(51) Int. Cl.[7] ..... E21B 23/02

(52) U.S. Cl. ..... 166/380; 166/55.8; 166/207; 72/119

(58) Field of Search ..... 166/277, 284, 166/207, 380, 55.1, 55.8; 72/75, 118, 119, 393

(56) References Cited

U.S. PATENT DOCUMENTS 761,518 A 5/1904 Lykken
1,324,303 A 12/1919 Carmichael
1,545,039 A 7/1925 Deavers
1,561,418 A 11/1925 Duda
1,569,729 A 1/1926 Duda (List continued on next page.)

FOREIGN PATENT DOCUMENTS

EP 0 952 305 10/1999 ..... E21B/43/10
EP 0 961 007 A2 12/1999 ..... E21B/33/10

(List continued on next page.)

OTHER PUBLICATIONS

U.S. patent application Ser. No. 09/470,176, Metcalfe et al., filed Dec. 22, 1999.

(List continued on next page.)

*Primary Examiner*—William Neuder
(74) *Attorney, Agent, or Firm*—Moser, Patterson & Sheridan, L.L.P.

(57) ABSTRACT

An improved expansion assembly for an expander tool is provided. The expander tool is used to expand a surrounding tubular body within a wellbore. The expansion assembly first comprises a piston disposed within a recess of the expander tool. The top surface of the piston defines a bearing cavity configured to closely receive a roller. A shoe is further disposed on the top surface of the piston to receive a lower portion of the roller. In one arrangement, the roller is a tapered cylindrical roller actuated by hydraulic pressure applied from within the bore of the expander tool. Actuation of the tool forces the pistons to radially extend away from the body of the tool within the recesses. This, in turn, causes the roller members to engage the inner surface of the surrounding tubular body to be expanded. Rotation of the expander tool causes the rollers to at least partially rotate within the bearing cavity. This arrangement reduces the geometric size of the expansion assembly, affording a larger inner diameter for the hollow bore of the expander tool itself.

30 Claims, 5 Drawing Sheets

U.S. PATENT DOCUMENTS

| | | | | |
|---|---|---|---|---|
| 1,597,212 | A | 8/1926 | Spengler | |
| 1,930,825 | A | 10/1933 | Raymond | 153/81 |
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |
| 2,898,971 | A | 9/1959 | Hempel | 153/82 |
| 3,087,546 | A | 4/1963 | Wooley | 166/46 |
| 3,195,646 | A | 7/1965 | Brown | 166/208 |
| 3,467,180 | A | 9/1969 | Pensotti | 165/180 |
| 3,818,734 | A | 6/1974 | Bateman | 72/75 |
| 3,911,707 | A | 10/1975 | Minakov et al. | 72/76 |
| 4,069,573 | A | 1/1978 | Rogers, Jr. et al. | 29/421 R |
| 4,099,400 | A | 7/1978 | Schott | 72/122 |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,324,407 | A | 4/1982 | Upham et al. | 277/27 |
| 4,429,620 | A | 2/1984 | Burkhardt et al. | 91/395 |
| 4,502,308 | A | 3/1985 | Kelly | 72/58 |
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,271,472 | A | 12/1993 | Leturno | 175/107 |
| 5,322,127 | A | 6/1994 | McNair et al. | 166/313 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,560,426 | A | 10/1996 | Trahan et al. | 166/120 |
| 5,685,369 | A | 11/1997 | Ellis et al. | 166/195 |
| 5,901,787 | A | 5/1999 | Boyle | 166/135 |
| 6,021,850 | A | 2/2000 | Wood et al. | 166/380 |
| 6,098,717 | A | 8/2000 | Bailey et al. | 166/382 |
| 6,325,148 | B1 | 12/2001 | Trahan et al. | 166/297 |
| 6,457,532 | B1 * | 10/2002 | Simpson | 166/380 |
| 2002/0104647 | A1 * | 8/2002 | Lawrence | 166/55.1 |

FOREIGN PATENT DOCUMENTS

| | | | |
|---|---|---|---|
| GB | 1 457 843 | 12/1976 | B21D/39/10 |
| GB | 2 313 860 | 12/1997 | E21B/10/34 |
| GB | 2 320 734 A | 7/1998 | E21B/33/127 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |

OTHER PUBLICATIONS

U.S. patent application Ser. No. 09/469,690, Abercrombie, filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

U.S. patent application Ser. No. 09/470,154, Metcalfe et al., filed Dec. 22, 1999.

U.S. patent application Ser. No. 09/469,681, Metcalfe et al., filed Dec. 22, 1999.

U.S. patent application Ser. No. 09/462,654, Metcalfe, filed Dec. 19, 2000.

* cited by examiner

EXPANSION ASSEMBLY FOR A TUBULAR EXPANDER TOOL, AND METHOD OF TUBULAR EXPANSION

RELATED APPLICATIONS

This application is a continuation-in-part of an earlier application entitled "IMPROVED EXPANSION ASSEMBLY FOR A TUBULAR EXPANDER TOOL, AND METHOD OF TUBULAR EXPANSION." That application was filed on Feb. 4, 2002, and has U.S. Ser. No. 10/066,824. The parent application is incorporated herein in its entirety by reference.

The parent application, in turn, was a continuation-in-part of an application entitled "PROCEDURES AND EQUIPMENT FOR PROFILING AND JOINTING OF PIPE." That original application was filed on Dec. 22, 1999, and has U.S. Ser. No. 09/469,690 now U.S. Pat. No. 6,457,532. The original application remains pending, and is also incorporated herein in its entirety, by reference.

BACKGROUND OF THE INVENTION

1. Field of the Invention

The present invention relates to wellbore completion. More particularly, the invention relates to an apparatus and method for expanding a tubular body. More particularly still, the apparatus relates to an expander tool for expanding a section of tubulars within a wellbore.

2. Description of the Related Art

Hydrocarbon and other wells are completed by forming a borehole in the earth and then lining the borehole with steel pipe or casing to form a wellbore. After a section of wellbore is formed by drilling, a string of casing is lowered into the wellbore and temporarily hung therein from the surface of the well. Using apparatus known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever decreasing diameter.

Apparatus and methods are emerging that permit tubular bodies to be expanded within a wellbore. The apparatus typically includes an expander tool that is run into the wellbore on a working string. The expander tool includes radially expandable members, or "expansion assemblies," which are urged radially outward from a body of the expander tool, either in response to mechanical forces, or in response to fluid injected into the working string. The expansion assemblies are expanded into contact with a surrounding tubular body. Outward force applied by the expansion assemblies cause the surrounding tubular to be expanded. Rotation of the expander tool, in turn, creates a radial expansion of the tubular.

Multiple uses for expandable tubulars are being discovered. For example, an intermediate string of casing can be hung off of a string of surface casing by expanding an upper portion of the intermediate casing string into frictional contact with the lower portion of surface casing therearound. Additionally, a sand screen can be expanded into contact with a surrounding formation in order to enlarge the inner diameter of the wellbore. Additional applications for the expansion of downhole tubulars exist.

An exemplary embodiment of an expander tool previously known as of the filing of this continuation-in-part application is shown in FIG. 1. FIG. 1 is an exploded view of an exemplary expander tool 100. FIG. 2 presents the same expander tool 100 in cross-section, with the view taken across line 2—2 of FIG. 1.

The expander tool 100 has a body 102 which is hollow and generally tubular. The central body 102 has a plurality of recesses 114 to hold a respective expansion assembly 110. Each of the recesses 114 has parallel sides and holds a respective piston 120. The pistons 120 are radially slidable, one piston 120 being slidably sealed within each recess 114. The back side of each piston 120 is exposed to the pressure of fluid within a hollow bore 115 of the expander tool 100. In this manner, pressurized fluid provided from the surface of the well can actuate the pistons 120 and cause them to extend outwardly.

Disposed within each piston 120 is a roller 116. In one embodiment of the expander tool 100, the rollers 116 are near cylindrical and slightly barreled. Such a roller 116 is sometimes referred to as a "parallel" roller because it includes a side portion that resides parallel to the surrounding tubular to be expanded. Each of the rollers 116 is supported by a shaft 118 at each end of the respective roller 116 for rotation about a respective axis. The rollers 116 are generally parallel to the longitudinal axis of the tool 100. In the arrangement of FIG. 1, the plurality of rollers 116 are radially offset at mutual 120-degree circumferential separations around the central body 102. In the arrangement shown in FIG. 1, two offset rows of rollers 116 are shown. However, only one row, or more than two rows of roller 116, may be incorporated into the body 102.

As sufficient pressure is generated on the piston surface behind the expansion assembly 110, the tubular being acted upon (not shown) by the expander tool 110 is expanded past its point of elastic deformation. In this manner, the inner and outer diameter of the tubular is increased within the wellbore. By rotating the expander tool 100 in the wellbore and/or moving the expander tool 100 axially in the wellbore with the expansion assemblies 110 actuated, a tubular can be expanded into plastic deformation along a predetermined length. Where the expander tool 100 is translated within the wellbore, the shaft 118 serves as a thrust bearing.

One disadvantage to known expander tools, such as the hydraulic tool 100 shown in FIGS. 1–2, is the inherently restricted size of the hollow bore 115. In this respect, the dimension of the bore 115 is limited by the size of the expansion assemblies 110 radially disposed around the body 102 of the tool 100. The constricted bore 115 size, in turn, imposes a limitation on the volume of fluid that can be injected through the working string at any given pressure. Further, the dimensions of the bore 115 in known expander tools place a limit on the types of other tools which can be dropped through the expander tool 100. Examples of such tools include balls, darts, retrieving instruments, fishing tools, bridge plugs and other common wellbore completion tools.

In addition, the tubulars being expanded within a wellbore generally define a thick-walled, high-strength steel body. To effectively expand such tubulars, a large cross-sectional geometry is required for the roller body 116. This further limits the inner bore diameter, thereby preventing adequate flow rates, and minimizing the space available to run equipment through the inner bore 115. Also, the stresses required to expand the material are very high; hence, reducing the roller body size to accommodate a larger inner bore diameter would mechanically weaken the roller mechanism, thereby compromising the functionality of the expansion assembly.

Therefore, a need exists for an expander tool which provides for a larger configuration for the hollow bore 115 therein. Further, a need exists for an expander tool which reduces the size of the expansion assemblies 110 around the tool 100 so as to allow for a greater bore 115 size. Further, a need exists for an expander tool having expansion assemblies which do not rely upon rollers 116 rotating about a shaft 118 at a spaced apart distance from the piston member 120.

SUMMARY OF THE INVENTION

The present invention provides an apparatus for expanding a surrounding tubular body. More specifically, an improved expansion assembly for a radially rotated expander tool is disclosed. In addition, a method for expanding a tubular body, such as a string of casing within a hydrocarbon wellbore, is provided, which employs the improved expansion assembly of the present invention.

The expansion assembly first comprises a piston. The piston is preferably an elongated wafer-shaped body which is sealingly disposed within an appropriately configured recess of an expander tool. The piston has a top surface and a bottom surface. The top surface includes a bearing cavity for receiving a roller. In the expansion assembly of the present invention, the roller does not rotate about a shaft; rather, the roller is permitted to rotate within the bearing cavity of the piston during an expansion operation.

The bearing cavity of the piston is configured to retain the roller while it is operated within a wellbore. In one aspect, the expansion assembly provides a headrest for supporting the upper end of the roller. The piston further provides a shoe for receiving the lower end of the roller. The lower end of the roller is gravitationally retained within the shoe during operation.

In another aspect, the expansion assembly of the present invention provides for a cap piece. The cap piece is fitted over the headrest to further secure the headrest onto the piston member. In one aspect, the headrest further helps to secure the roller within the bearing cavity during operation.

The bottom surface of the piston is exposed to an outwardly radial force. In one aspect, the force is a hydraulic force generated by wellbore fluids within the bore of the expander tool. In another aspect, the hydraulic pressure is from a dedicated fluid reservoir in fluid communication with the expander tool downhole. Alternatively, a mechanical force may be employed. The piston is moved radially outward from the body of the expander tool but within the recess in response to the radially outward force. Because the roller is held closely to the piston within the bearing cavity, greater space is accommodated for the bore within the expander tool.

BRIEF DESCRIPTION OF THE DRAWINGS

So that the manner in which the above recited features of the present invention are attained and can be understood in detail, a more particular description of the invention, briefly summarized above, may be had by reference to the embodiments thereof, which are illustrated in the appended drawings (FIGS. 3–7). It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 3:
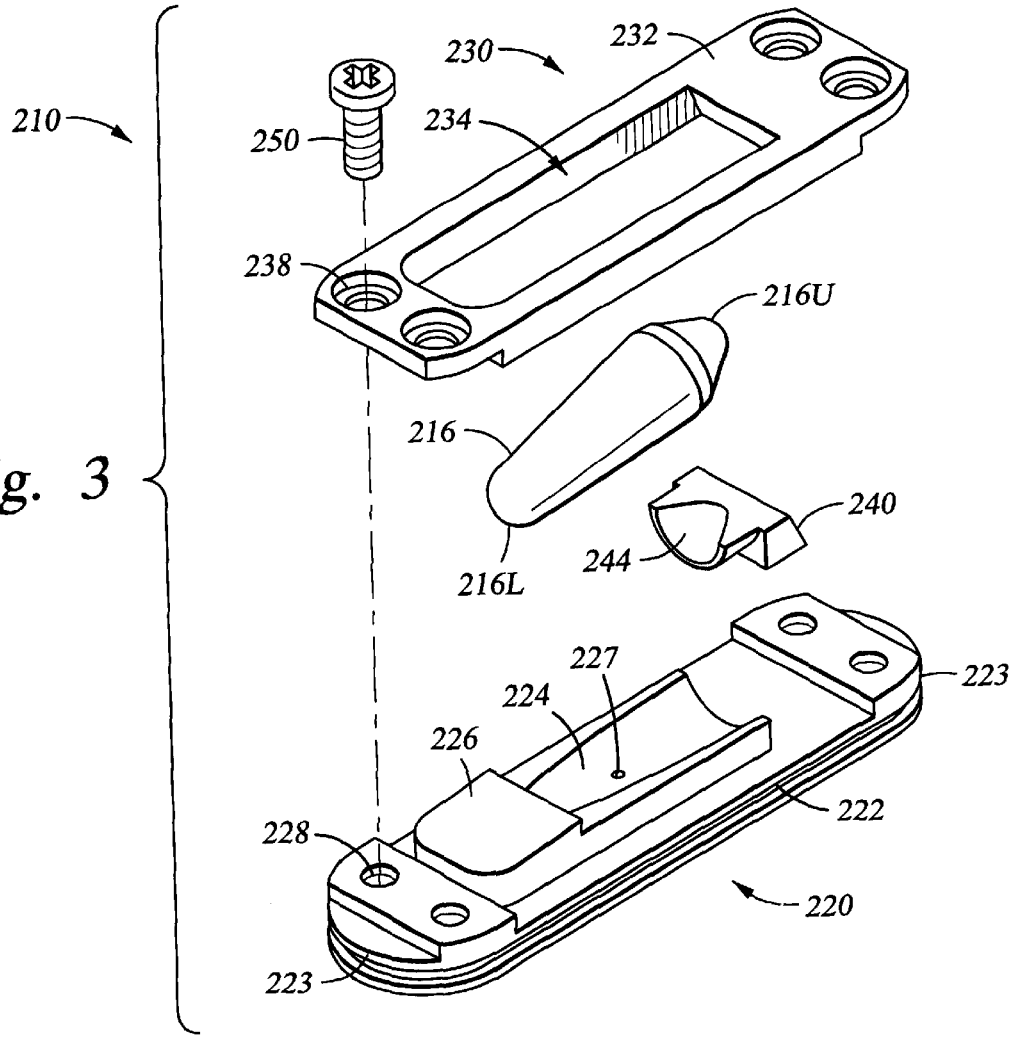
FIG. 3 is an exploded view of an expansion assembly of the present invention. The expansion assembly is shown in perspective view. The expansion assembly is designed to operate within a body of an expander tool, such as a hydraulically actuated expander tool.

FIG. 3 presents a perspective view of an expansion assembly 210 of the present invention. The expansion assembly 210 is designed to be utilized within an expander tool (discussed later in connection with FIG. 6) for expanding a surrounding tubular body (not shown in FIG. 3). The parts of the expansion assembly 210 are presented in an exploded view for ease of reference.

The expansion assembly 210 first comprises a piston 220. As will be discussed, the piston 220 sealingly resides within a recess 214 of an expander tool 200. In the arrangement shown in FIG. 3, the piston 220 defines an elongated, wafer-shaped member capable of sliding outwardly from the expander tool in response to hydraulic pressure within the bore 215 of the expander tool 200.

The piston 220 includes a base 222 that runs the length of the piston 220. An outer lip 223 is formed at either end of the base 222 in order to provide a shoulder within the recess 214 of the expander tool 200. In this way, radial movement of the piston 220 away from the body 202 of the tool 200 is limited.

The base 222 of the piston 220 has a top surface and a bottom surface. The bottom surface is exposed to hydraulic pressure within the bore 215 of the expander tool 200. The top surface of the base 222 comprises a bearing cavity 224. As seen in FIG. 3, the bearing cavity 224 defines an elongated cradle configured to receive a roller 216. In one aspect, the bearing cavity 224 has a polished arcuate surface for closely holding a roller 216. In this way, the coefficient of friction between the bearing cavity 224 and the roller 216 is less than the coefficient of friction between the roller 216 and a surrounding tubular (shown in FIG. 10) to be expanded.

Positioned over the lower end of the bearing cavity 224 is a shoe 226. The shoe 226 is configured to receive a lower portion 216L of the roller 216. In operation, the lower portion 216L of the roller 216 is gravitationally held within the shoe 226 during operation of the expansion assembly 210. The shoe 226 further serves to stabilize and support the roller 216 during an expansion operation. The shoe 226 is preferably fabricated from a hardened metal material such as steel so that it can aid in the expansion process.

An optional feature shown in the expansion assembly 210 of FIG. 3 is a lubrication port 227. The port 227 defines a through-opening through the piston 220, providing a path of fluid communication between the bore 215 of the expander tool 200 and the bearing cavity 224. The port 227 is sized to permit a small flow of fluids onto the surface of the bearing cavity 224 in order to facilitate rotation of the roller 216. In this respect, fluids will reduce the coefficient of friction between the roller 216 and the bearing cavity surface 224. In addition, the presence of fluid behind the roller 216 as it rotates will serve to cool the roller 216 during an expansion operation, thereby protecting the roller 216 from unnecessary wear.

It is recognized that the presence of a port 227 within the piston body 220 will reduce pressure behind the piston 220 due to hydraulic forces within the wellbore 10. However, such a pressure reduction is minimal where only a small port 227 is employed. In one aspect, the port 227 is only 0.50 cm in diameter, though other dimensions may be provided.

Also positioned on the top surface of the base 222 of the piston 220 is a headrest 240. The headrest is configured to receive an upper portion 216U of the roller member 216. In the exemplary arrangement shown in FIG. 3, the headrest 240 includes a highly polished, arcuate surface 224 configured to closely receive the upper portion 216U of the roller 216. In this way, the headrest 240 also serves as a cradle for the roller 216.

Figure 1:
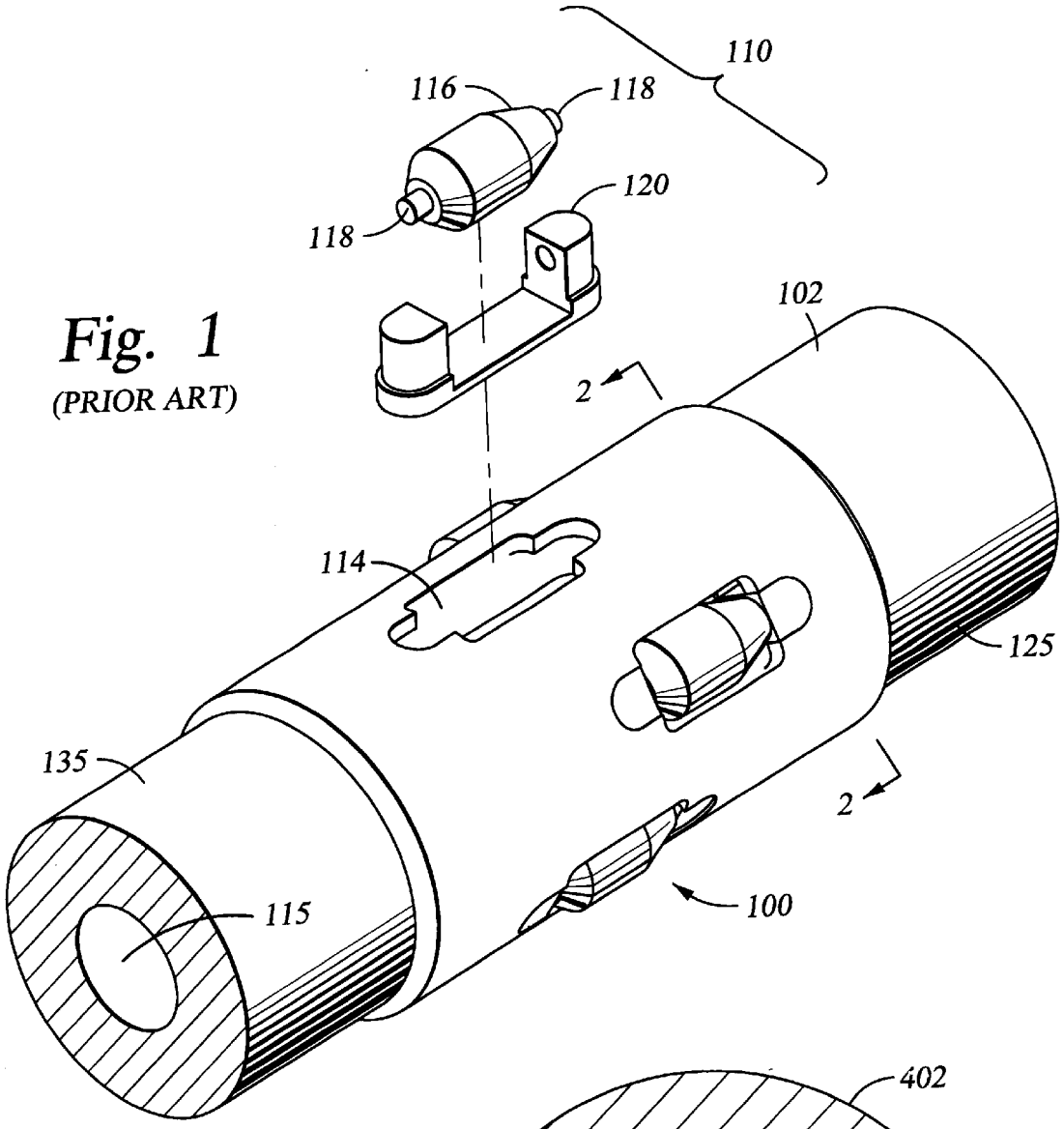
Fig. 1 (PRIOR ART)
FIG. 1 is an exploded view of an expander tool previously known as of the time of the filing of this continuation-in-part application. The roller is consistent with an embodiment described in the pending parent application. Visible in FIG. 1 is an expansion assembly having a roller which rotates about a shaft.
Figure 2:
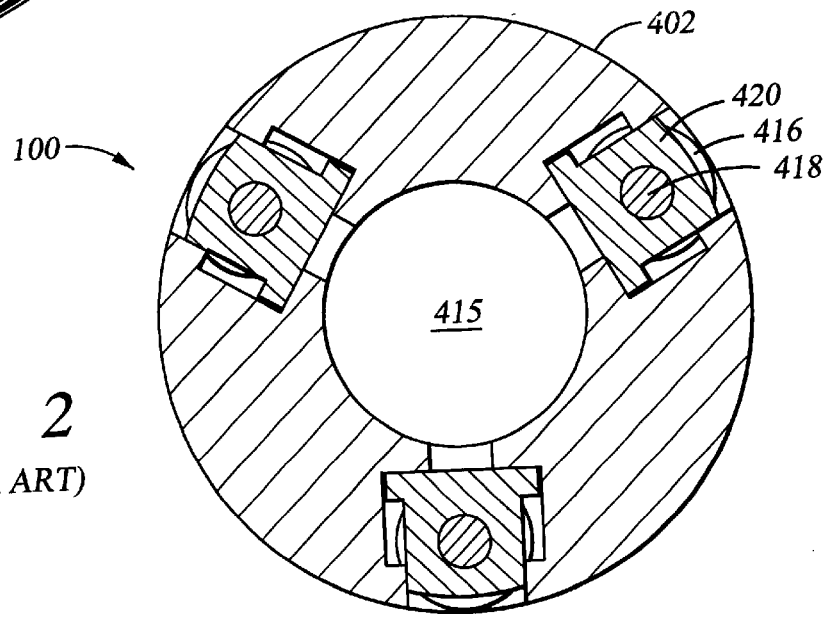
Fig. 2 (PRIOR ART)
FIG. 2 is a cross-sectional view of the expander tool of FIG. 1, taken across line 2—2 of FIG. 1.

In the view of FIG. 3, the roller 216 is shown positioned above the piston 220. It can be seen that the roller 216 does not include an axle or shaft about which rotation is provided; instead, the roller 216 is permitted to rotationally move within the bearing cavity 224 of the piston 220, and upon the headrest 240. Removal of the shaft 118 from the previous embodiment of an expansion assembly 110 (FIG. 1) reduces the overall thickness of the body 202 of the new expander tool 202 (shown in FIG. 6), thereby saving valuable space within the wellbore.

The roller 216 illustrated in FIG. 3 has a generally frustoconical cross-section. This provides for an elongated tapered section. For this reason, such a roller configuration is sometimes referred to as a "tapered" roller. The elongated tapered surface of the roller 216 more readily accommodates axial movement of the expander tool 200 during an expansion process. In this respect, the tapered surface provides for a more gentle contact angle with the surrounding casing than is present in a parallel roller (seen in FIG. 1). It is to be appreciated, however, that other roller shapes are possible for the present invention, including a parallel roller. For example, the roller 116 may have a cross-sectional shape that is barrel-shaped, semi-spherical, multifaceted, elliptical or any other cross sectional shape suited to the expansion operation to be conducted within a tubular.

The tapered roller 216 is fabricated from a material of appreciable strength and toughness in order to withstand the high hertzian stresses imposed upon the roller 216 during an expansion operation. Preferably, the roller 216 is fabricated from a ceramic or other hardened composite material. Alternatively, a steel or other hard metal alloy may be used. In any arrangement, it is understood that some sacrifice of the material of the roller 216 may occur due to the very high stresses required to expand a surrounding metal tubular.

The tapered roller of the expansion assembly 210 rotates within the bearing cavity 224 during an expansion operation. Because the roller 216 does not ride upon a shaft, the roller 216 is permitted to at least partially rotate and to partially skid within the bearing cavity 224.

In one aspect, the orientation of the tapered roller 216 is skewed relative to the longitudinal center axis of the bore of the expander tool 200. To accomplish this, the recess 214 in the expander tool body 202 is tilted so that the longitudinal axis of the roller 216 is out of parallel with the longitudinal axis of the tool 200. Preferably, the angle of skew is only approximately 1.5 degrees. The advantage is that simultaneous rotation and translation of the expander tool 200 allows the roller 216 to predominantly roll against the surrounding casing being expanded, without skidding against it. This, in turn, causes the thrust system, i.e., the mechanism for raising or lowering the expander tool 200 within the wellbore, to operate more efficiently.

It is understood that "skewing" of the roller 216 is an optional feature. Further, the degree of tilt of the roller 216 is a matter of designer's discretion. In any event, the angle of tilt must be away from the direction of rotation of the tool 200 so as to enable the tool 200 to more freely be translated within the wellbore. By employing such an angle, the roller 216 will tend to pull itself into the casing as it is expanded (depending on the direction of 'skew' and rotation). This again reduces the thrust load required to push the roller into the casing during translation. Tilting the roller 216 further causes the roller 216 to gain an increased projected depth to expand the casing. This is true for both parallel and tapered rollers.

In one aspect, the expansion assembly 210 includes a cap piece 230. An optional cap piece 230 is included in the arrangement of FIG. 3. The cap piece 230 defines an elongated body configured to be connected to the piston 220. In this respect, connector openings 238 within the cap piece 230 are configured to align with connector openings 228 within the piston 220. In the arrangement of FIG. 3, connection of the cap piece 230 is made with the piston 220 by means of threaded screws 250.

Figure 4:
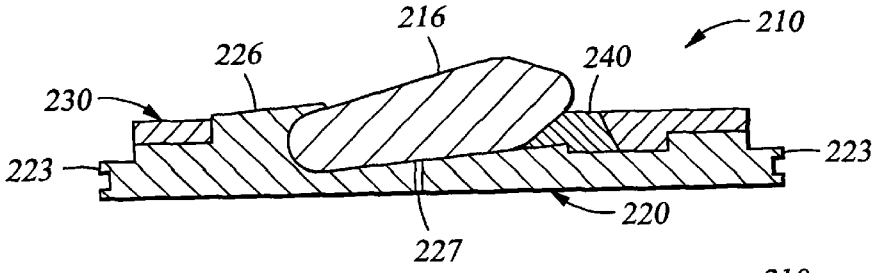
FIG. 4 is a side, cross-sectional view of the expansion assembly of FIG. 3.

The cap piece 230 includes a top surface 232 configured to support and partially enclose the headrest 240 between the cap piece 230 and the piston base 222. Positioning of the top surface 232 over a portion of the headrest 240 is more fully seen in the side cross-sectional view of FIG. 4.

The cap piece 230 also comprises an opening 234. The opening 234 is configured to receive the roller 216. The opening 234 permits the roller 216 to rotate within the bearing cavity 224.

Figure 5:
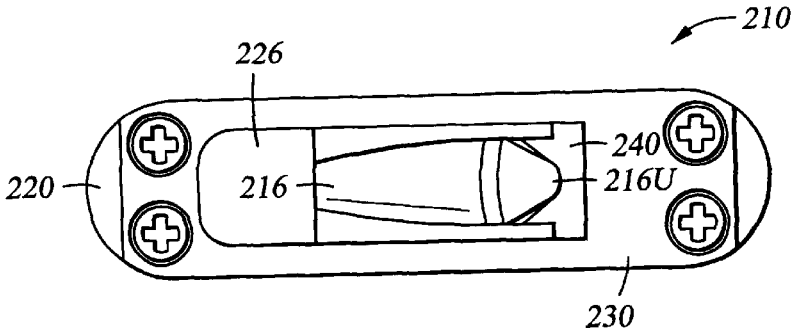
FIG. 5 is a top view of the expansion assembly of FIG. 3.

FIG. 5 presents a top view of the expansion assembly of FIG. 3. In this view, the configuration of the roller 216, and the disposition of the roller 216 upon the base 222 of the piston 220 can be more fully seen. The preferred tapered configuration of the roller 216 is more fully demonstrated.

Figure 6:
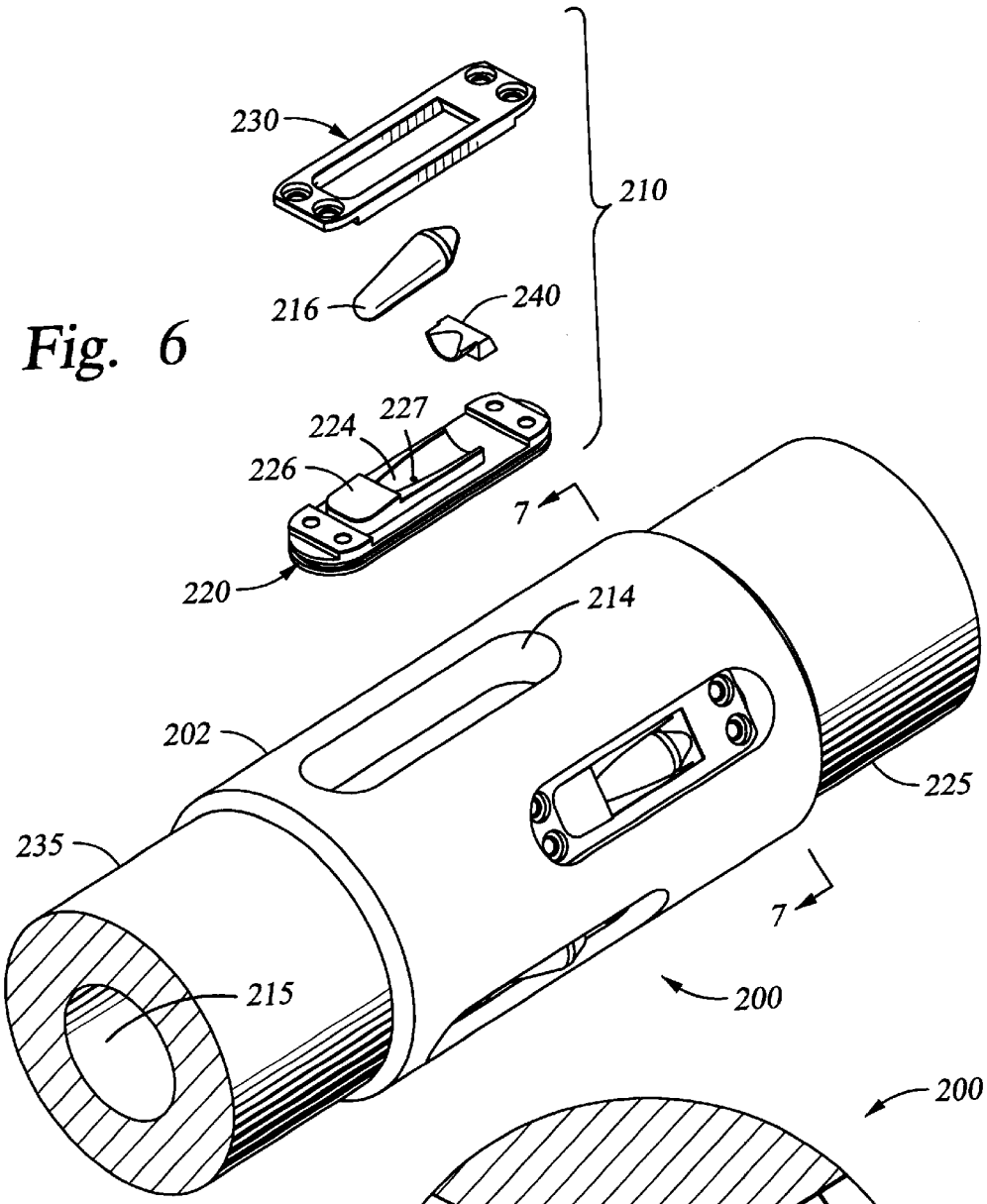
FIG. 6 is an exploded view of an expander tool which includes an expansion assembly of the present invention.

Referring now to FIG. 6, FIG. 6 presents a perspective view of an expander tool 200 as might be used with the expansion assembly 210 of the present invention. The view in FIG. 6 shows the piston 220, roller 216 and cap piece 230 in exploded arrangement above a recess 214. A plurality of recesses 214 is fabricated into the body 202 of the expander tool 200.

The body 202 of the expander tool 200 defines a tubular body. A bore 215 is seen running through the body 202. It is to be observed that the bore 215 of the improved expander tool 200 is larger than the bore 115 of the previously known expander tool, shown in FIG. 1.

Connector members 225, 235 are shown disposed at either end of the expander tool 200. An upper connector 225 is typically connected to a working string, as will be shown in a later figure. A lower connector 235 may be used for connecting the expander tool 200 to other tools further downhole. Alternatively, connector 235 may simply define a deadhead.

Figure 7:
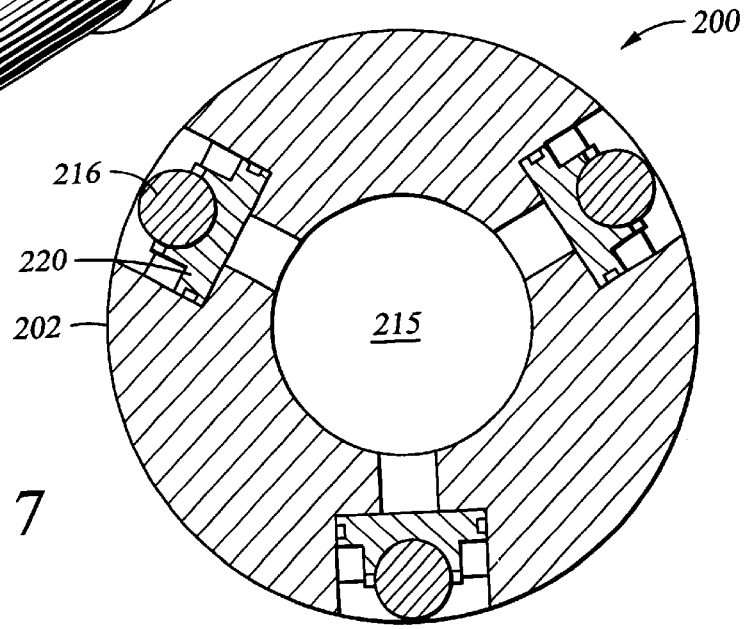
FIG. 7 is a cross-sectional view of the expander tool of FIG. 6, taken across line 7—7 of FIG. 6.

FIG. 7 presents a cross-sectional view of the expander tool 200 of FIG. 6. The view is taken across line 7—7 of FIG. 6. More visible in this view is the enlarged dimension of the bore 215 permitted by the novel expansion assembly 210 of the present invention, depending upon the complexity of the completion operation.

Figure 8:
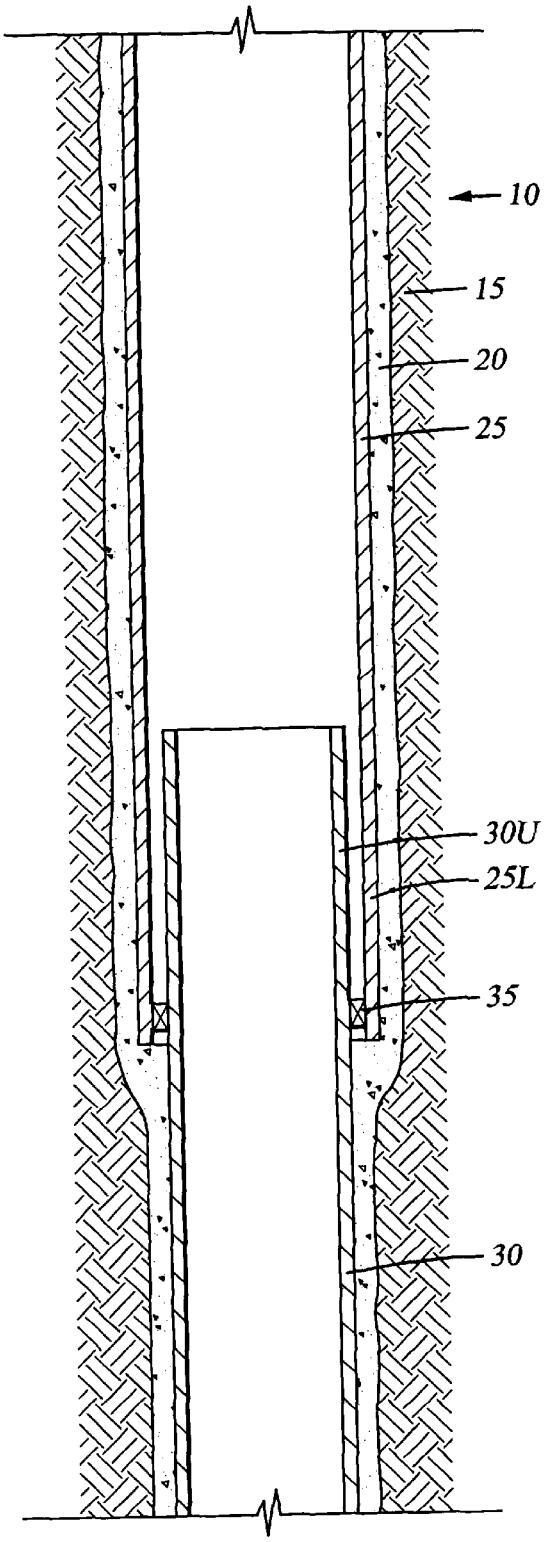
FIG. 8 is a cross-sectional view of a wellbore. The wellbore includes an upper string of casing, and a lower string of casing having been hung off of the upper string of casing. In this view, the lower string of casing serves as a tubular body to be expanded.

In order to demonstrate the operation of the expander tool 200, FIGS. 8–11 have been provided. FIG. 8 provides a cross-sectional view of the wellbore 10. The wellbore is cased with an upper string of casing 25. The upper string of casing 25 has been cemented into a surrounding formation 15 by a slurry of cement 20. The wellbore 10 also includes a lower string of casing 30, sometimes referred to as a "liner." The lower string of casing 30 has an upper portion 30U which has been positioned in the wellbore 10 at such a depth as to overlap with a lower portion 25L of the upper string of casing 25. It can be seen that the lower string of casing 30 is also cemented into the wellbore 10. A packer 35 is shown schematically in FIG. 8, providing support for the lower string of casing 30 within the upper string of casing 25 before the cement 20 behind the lower sting of casing 25 is cured.

Figure 9:
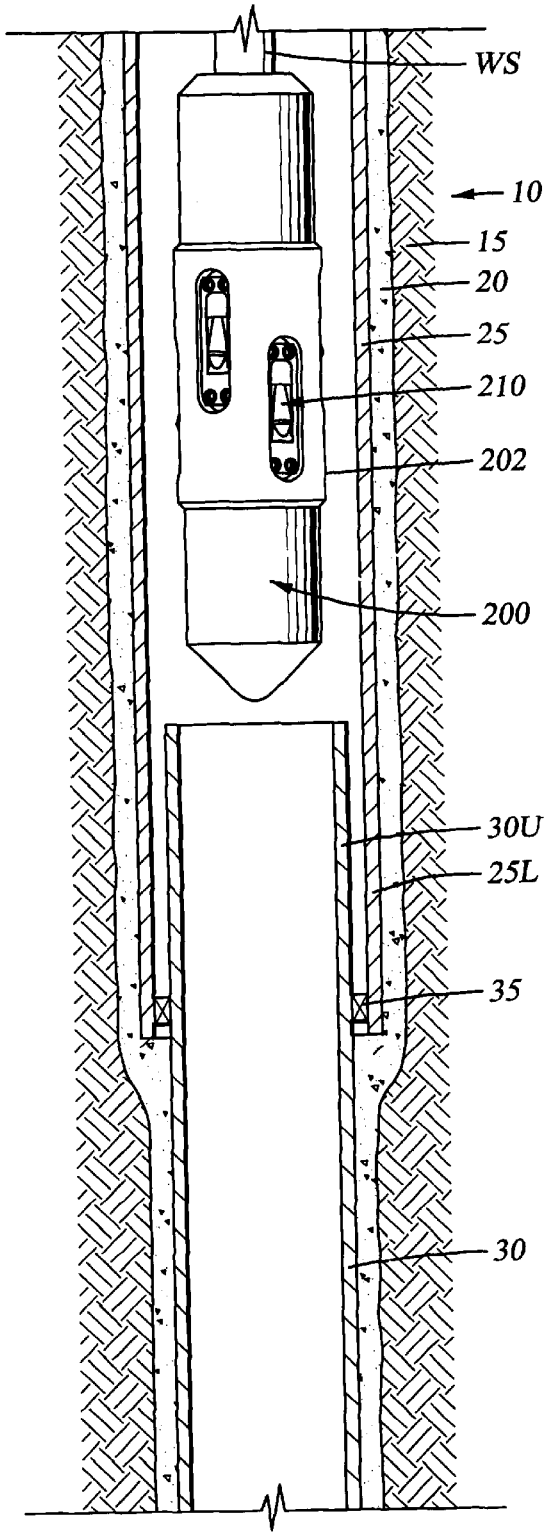
FIG. 9 presents the wellbore of FIG. 8. In the view, an expander tool which includes expansion assemblies of the present invention is being lowered into the wellbore on a working string.

FIG. 9 presents the wellbore of FIG. 8, with a working string WS being lowered into the wellbore 10. Affixed at the bottom of the working string WS is an expander tool 200. The expander tool 200 includes improved expansion assemblies 210 of the present invention. In this view, the expansion assemblies 210 have not yet been actuated.

Figure 10:
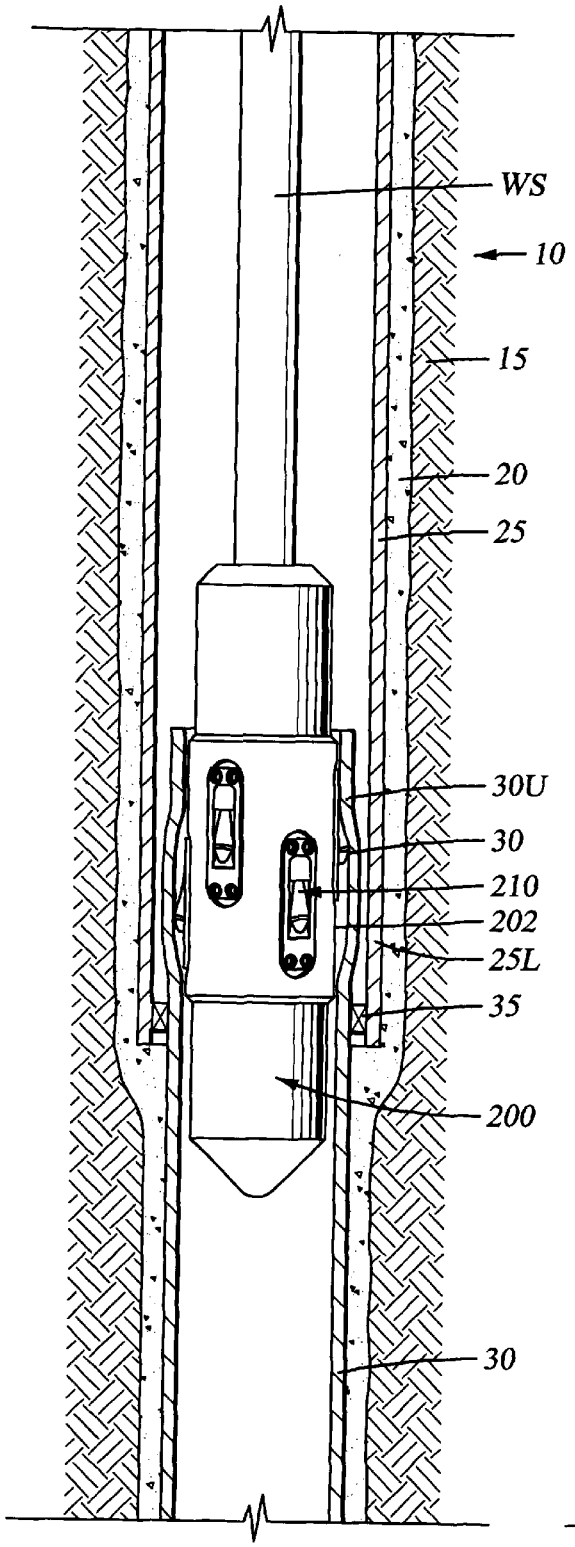
FIG. 10 presents the wellbore of FIG. 8, with the expander tool being actuated in order to expand the lower string of casing into the upper string of casing, thereby further hanging the liner from the upper string of casing.

Turning now to FIG. 10, the expander tool 200 has been lowered to a depth within the wellbore 10 adjacent the overlapping strings of casing 25L, 30U. The expansion assemblies 210 of the expander tool 200 have been actuated. In this manner, the upper portion 30U of the lower string of casing 30 can be expanded into frictional engagement with the surrounding lower portion 25L of the upper string of casing 20. Expansion of the lower casing string 30U in the view of FIG. 10 is from the bottom, up. For such an expansion operation, the expansion assemblies 210 are oriented so that the elongated tapered surfaces are facing upward. As noted, the elongated tapered surface of the roller 216 more readily accommodates axial movement of the expander tool 200 during an expansion process. It is, of course, understood that the expander tool 200 may be oriented in the opposite direction, i.e., "turned over," to facilitate expansion from the top, down.

In order to actuate the expander tool 200, fluid is injected into the working string WS. Fluid under pressure then travels downhole through the working string WS and into the perforated tubular bore 215 of the tool 200. From there, fluid contacts the bottom surfaces of the pistons 220. As hydraulic pressure is increased, fluid forces the pistons 220 outwardly from their respective recesses 214. This, in turn, causes the rollers 216 to make contact with the inner surface of the liner 30L. With a predetermined amount of fluid pressure acting on the piston surface 220, the lower string of expandable liner 30L is expanded past its elastic limits. Fluid exits the expander tool 200 through the bottom connector 235 at the base of the tool 200.

It will be understood by those of ordinary skill in the art that the working string WS shown in FIGS. 9 and 10 is highly schematic. It is understood that numerous other tools may and commonly are employed in connection with a well completion operation. For example, the lower string of casing 30 would typically be run into the wellbore 10 on the working string WS itself. Other tools would be included on the working string WS and the liner 30, including a cement shoe (not shown) and a wiper plug (also not shown). Numerous other tools to aid in the cementing and expansion operation may also be employed, such as a swivel (not shown) and a collet or dog assembly (not shown) for connecting the working string WS with the liner 30. Again, it is understood that the depictions in FIGS. 9 and 10 are simply to demonstrate one of numerous uses for an expander tool 200, and to demonstrate the operation of the expansion assembly 210 of the present invention.

Figure 11:
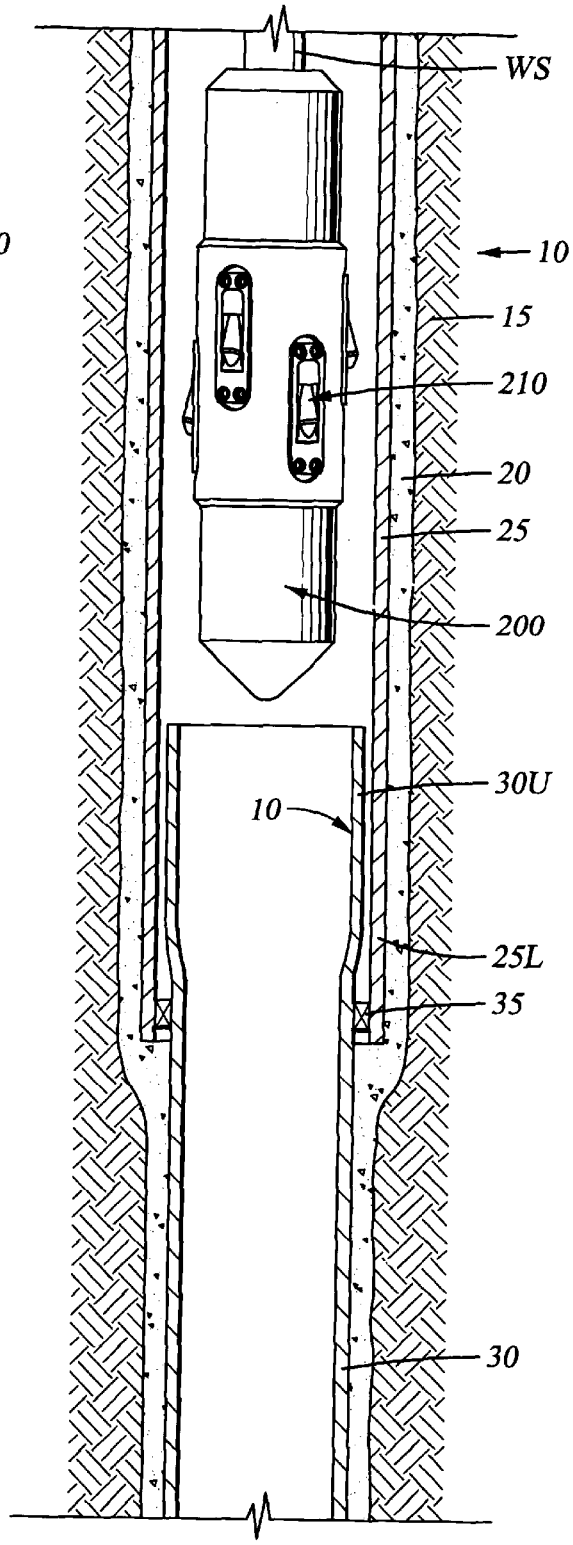
FIG. 11 presents the wellbore of FIG. 10, in which the lower string of casing has been expanded into the upper string of casing along a desired length. The expander tool has been removed from the wellbore.

FIG. 11 presents the lower string of casing 30 having been expanded into frictional engagement with the surrounding upper string of casing 25 along a desired length. In this view, the upper portion 30U of the lower string of casing 30 has utility as a polished bore receptacle. Alternatively, a separate polished bore receptacle can be landed into the upper portion 30 view of the lower string of casing 30 with greater sealing capability. Further, a larger diameter of tubing (not shown) may be landed into the liner 30 due to the expanded upper portion 30U of the liner 30.

As demonstrated, an improved expansion assembly 210 for an expander tool 200 has been provided. In this respect, the rollers 216 of the expansion apparatus 210 are able to rotate and, at times, skid inside of a bearing cavity 224. In this way, the shaft of previous embodiments of an expander tool has been removed, and a bearing system has been provided in its place. The entire bearing system can be angled to allow the expansion assembly 210 to be rotated and axially translated simultaneously. Because no shaft or thrust bearing apparatus is needed, the expansion assembly components 210 are geometrically reduced, thereby affording a larger inner diameter for the bore of the expander tool.

The above description is provided in the context of a hydraulic expander tool. Hydraulic pressure may be supplied by the application of wellbore of fluids under pressure against the back surface of the piston, or from another source, such as a dedicated fluid reservoir in fluid communication with the back surface of the piston. It is understood that the present invention includes expander tools in which the pistons are moveable in response to other radially outward forces, such as mechanical forces. While the foregoing is directed to embodiments of the present invention, other and further embodiments of the invention may be devised without departing from the basic scope thereof, and the scope thereof is determined by the claims that follow.

What is claimed is:

1. An expansion assembly for an expander tool for expanding a surrounding tubular body, the expansion assembly being disposed within a recess in the body of the expander tool, and the expander tool having a bore therethrough, the expansion assembly comprising:

a piston disposed within the recess of the expander tool, the piston having a bottom surface and a top surface, the bottom surface being exposed to a radially outward force within the bore of the expander tool, and the piston being outwardly extendable from the body of the expander tool within the recess in response to the radially outward force; and a roller residing on the top surface of the piston, such that the roller is permitted to at least partially rotate upon the top surface of the piston when the piston is extended away from the body of the expander tool and the roller engages a surrounding tubular body.

2. The expansion assembly of claim 1, wherein the top surface defines a bearing cavity for closely receiving the roller.

3. The expansion assembly of claim 2, wherein the top surface bearing cavity defines a highly polished, bearing cradle for receiving the roller.

4. The expansion assembly of claim 3, wherein the top surface further comprises a shoe for gravitationally receiving the roller at an end.

5. The expansion assembly of claim 4, further comprising a headrest on the top surface of the piston, the headrest configured to receive a portion of the roller at an end opposite the shoe.

6. The expansion assembly of claim 5, wherein the headrest defines a bearing cavity for closely receiving the upper portion of the roller.

7. The expansion assembly of claim 6, wherein the headrest bearing cavity defines a polished, arcuate bearing cradle for receiving the roller.

8. The expansion assembly of claim 2, wherein the roller defines a tapered body having an elongated tapered surface.

9. The expansion assembly of claim 8, wherein the orientation of the roller is skewed relative to the longitudinal center axis of the bore of the expander tool.

10. The expansion assembly of claim 9, wherein the radially outward forces are hydraulic forces from within the bore of the expander tool.

11. The expansion assembly of claim 10, wherein the piston sealingly resides within the recess of the body of the expander.

12. The expansion assembly of claim 10, further comprising a port within the piston so as to provide a path of fluid communication between the bore of the expander tool and the top surface, thereby providing lubrication between the roller and the top surface during an expansion operation.

13. The expansion assembly of claim 6, further comprising a cap piece for covering the top surface of the piston, the cap piece providing structural support for the headrest.

14. An expansion assembly for a hydraulic expander tool for expanding a surrounding tubular body, the expansion assembly being sealingly disposed within a recess in the body of the expander tool, and the expander tool having a bore therethrough, the expansion assembly comprising:

a piston residing within the recess of the expander tool, and being outwardly extendable from the body of the expander tool within the recess in response to hydraulic pressure within the bore of the expander tool, the piston comprising a bottom surface exposed to fluid pressure within the expander tool, and a top surface defining a bearing cavity; and a roller residing on the bearing cavity of the piston, the roller having an outer surface resting on the bearing cavity itself such that engagement of the roller surface to and rotation within the surrounding tubular body causes the roller to at least partially rotate within the bearing cavity.

15. The expansion assembly of claim 14, wherein the roller defines a tapered body having an elongated surface oriented to contact the surrounding tubular body at an angle during the expansion process; and wherein the orientation of the roller is skewed relative to the longitudinal center axis of the bore of the expander tool.

16. The expansion assembly of claim 15, further comprising a shoe disposed upon the top surface of the piston for receiving a lower portion of the roller.

17. The expansion assembly of claim 16, further comprising a headrest disposed upon the top surface of the piston for supporting an upper portion of the roller.

18. The expansion assembly of claim 17, wherein the top surface bearing cavity defines an arcuate, polished bearing cradle for closely receiving a first end of the roller; and the headrest defines an arcuate, polished bearing cradle for closely receiving a second end of the roller.

19. The expansion assembly of claim 18, further comprising a port within the piston so as to provide a path of fluid communication between the bore of the expander tool and the top surface, thereby providing lubrication between the roller and the top surface during an expansion operation.

20. The expansion assembly of claim 18, further comprising a cap piece for covering the top surface of the piston, the cap piece providing structural support for the headrest.

21. A method for expanding a tubular body within a hydrocarbon wellbore, comprising the steps of:

attaching an expander tool to the lower end of a working string, the expander tool having a body and a plurality of recesses within the body, each recess receiving an expansion assembly, each expansion assembly comprising;

a piston residing within the recess of the expander tool, and being outwardly extendable from the body of the expander tool within the recess in response to radially outward forces within the bore of the expander tool, the piston comprising a bottom surface exposed to the radially outward forces within the expander tool, and a top surface defining a bearing cavity; and a roller residing on the bearing cavity of the piston, the roller having an outer surface resting on the bearing cavity itself such that engagement of the roller surface to and rotation within the surrounding tubular body causes the roller to at least partially rotate within the bearing cavity;

running the working string with the expander tool into a wellbore; and rotating the working string in order to radially expand a section of the surrounding tubular body within the wellbore.

22. The method for expanding a tubular body within a wellbore of claim 21, wherein the radially outward forces applied against the base of the piston are hydraulic forces; and the step of actuating the expansion assembly is accomplished by injecting hydraulic fluid under pressure into the working string.

23. The method for expanding a tubular body within a wellbore of claim 22, wherein:

the roller defines a tapered body having an elongated surface oriented to contact the surrounding tubular body at an angle during the expansion process; and the orientation of the roller is skewed relative to the longitudinal center axis of the bore of the expander tool.

24. The method for expanding a tubular body within a wellbore of claim 23, further comprising a shoe disposed upon the top surface of the piston for receiving an end portion of the roller.

25. The method for expanding a tubular body within a wellbore of claim 24, further comprising a headrest disposed upon the top surface of the piston for supporting a portion of the roller at an end opposite the shoe.

26. The method for expanding a tubular body within a wellbore of claim 25, wherein the top surface bearing cavity defines an arcuate, polished bearing cradle for closely receiving a first end of the roller; and the headrest defines an arcuate, polished bearing cradle for closely receiving a second end of the roller.

27. The method for expanding a tubular body within a wellbore of claim 26, further comprising a cap piece for covering the top surface of the piston, the cap piece providing structural support for the headrest.

28. The method for expanding a tubular body within a wellbore of claim 23, further comprising the step of translating the expander tool axially within the wellbore so as to expand the surrounding tubular body along a desired length.

29. The method for expanding a tubular body within a wellbore of claim 28, further comprising the step of relieving hydraulic pressure from within the expander tool.

30. The method for expanding a tubular body within a wellbore of claim 29, further comprising the step of removing the expander tool from the wellbore.

* * * * *